United States Patent [19]

Elkin

[11] Patent Number: 4,556,323

[45] Date of Patent: Dec. 3, 1985

[54] CONCRETE MIXING AND DISTRIBUTION EQUIPMENT

[76] Inventor: Luther V. Elkin, 2431 Rte. 286 West, Indiana, Pa. 15701

[21] Appl. No.: 587,301

[22] Filed: Mar. 7, 1984

[51] Int. Cl.[4] ..... B28C 5/14; B01F 11/00

[52] U.S. Cl. ..... 366/31; 366/118; 222/197

[58] Field of Search ..... 366/1, 30, 31, 33, 32, 366/34, 35, 38, 50, 154, 155, 108, 110, 113, 114, 117, 118; 222/368, 200, 196, 197

[56] References Cited

U.S. PATENT DOCUMENTS

| | | | |
|---|---|---|---|
| 1,900,458 | 3/1933 | Morrow . | |
| 2,792,152 | 5/1957 | Crowley | 222/197 |
| 3,164,305 | 1/1965 | Stevens | 222/197 |
| 3,310,293 | 3/1967 | Zimmerman | 259/148 |
| 3,336,011 | 8/1967 | Futty | 259/148 |
| 3,917,236 | 11/1975 | Hanson | 259/154 |
| 4,081,109 | 3/1978 | Kugle | 366/31 |
| 4,406,548 | 9/1983 | Haws | 366/8 |

*Primary Examiner*—Robert W. Jenkins

*Attorney, Agent, or Firm*—Webb, Burden, Robinson & Webb

[57] ABSTRACT

A cement mixing and distribution apparatus is disclosed and includes a metering wheel assembly and an adjustable bearing assembly for an auger shaft in a trough. The metering wheel includes a hollow, cylindrical drum rotatably mounted to a drum shaft, a plurality of circumferentially spaced and radially extending vanes mounted on the exterior surface of the drum and a plurality of hammer assemblies located within the drum and disposed along the length of the metering wheel. The hammer assemblies each include an inwardly directed impact plate and pusher plate angularly spaced apart and mounted on the inner surface of the drum, and a hammer rotatably mounted on the drum shaft and positioned between the impact plate and the pusher plate. Impact of the hammer against the impact plate vibrates the metering wheel. The adjustable beam assembly includes an end plate mounted near one end of the trough, a bearing mounted on the end plate and rotatably carrying the auger shaft, and an apparatus for adjusting the position of the end plate relative to the trough.

18 Claims, 12 Drawing Figures

CONCRETE MIXING AND DISTRIBUTION EQUIPMENT

BACKGROUND OF THE INVENTION

1. Field of the Invention

This invention relates to concrete mixing and distribution equipment and, more particularly, to an improved metering wheel assembly and to an adjustable bearing assembly for an auger.

2. Description of the Prior Art

The use of a feed or metering wheel in connection with concrete mixing and distribution equipment is well established in the prior art. Generally such a wheel is positioned at the bottom of a hopper or bin and dispenses a fluid or particulate material contained within the hopper. A typical metering wheel is formed of a cylindrical drum, with a plurality of vanes or fins extending radially outward from the surface of the drum, and the entire drum/fin assembly is contained within a circular housing. The housing is open at the top to connect with the hopper and is open at the bottom to provide an exit for the material. By selectively rotating the drum by, for example, a shaft connected to a motor, measured amounts of the material will be received between adjacent fins, moved to the bottom opening, and deposited by the force of gravity onto an underlying conveyor means. Examples of metering wheels are shown in U.S. Pat. Nos. 3,917,236 and 3,310,293.

When moving certain material through a metering wheel, such as cement or the like, it is recognized that a portion of the material may adhere to the fins and the outer surface of the drum. For such a material, the force of gravity alone is not sufficient to cause all of the material to drop through the bottom opening. When this occurs, any measurements done with the metering wheel are not accurate and the retained material may eventually bond onto the metering wheel and interfere with its operation.

It has been recognized in the prior art that applying an additional force to the metering wheel drum will reduce or preclude the adherence of the material thereto. For example, in U.S. Pat. No. 4,406,548 a feed wheel in a concrete mixing apparatus is disclosed which includes a hollow cylindrical drum with a plurality of circumferentially spaced fins or baffles provided around the outer periphery of the drum. The drum also includes a plurality of circumferentially spaced and inwardly directed flanges secured to the inner periphery thereof. A steel ball or the like is loosely disposed within the drum and knocks against or engages the flanges during rotation of the feed wheel. The engagement of the ball with the flanges provides a jarring of the drum and the baffles to preclude the adhering of the cement thereto. A similar arrangement is shown in U.S. Pat. No. 1,900,458 in connection with a roll feeder for measuring dry, pulverized materials such as cement. The inner surface of a hollow roll includes a pair of free rolling balls which rap against the roll and its end walls as it rotates and loosens any material adhering to the outer surface of the roll. Another arrangement is shown in U.S. Pat. No. 3,336,011. A pair of spring actuated hammers are provided adjacent the outside surface of the metering drum and are biased toward the drum. Each hammer travels up an inclined plane surface behind each vane as the drum rotates and, when the inclined surface ends at the vane, drops down and strikes the drum surface, thus releasing any cement adhered thereto.

A hammer assembly located on the outside of the metering wheel may itself become covered with cement adhered thereto and is not as convenient as a rapping means located entirely within the metering wheel drum. The arrangement of providing freely rotating balls has the disadvantage of not providing a sufficient force to adequately loosen the cement adhered thereto.

Accordingly, it is an object of the present invention to provide a means located within the metering wheel drum for knocking away any material adhered thereto which also provides a sufficient and sizeable jarring force.

It is also known in the art to transport concrete or cement along an elongated trough by means of a rotating helical screw or auger. Preferably the auger is in contact with the surface of the trough. Due to the abrasive nature of the material, the outer edges of the auger are quickly worn away.

Therefore, it is another object of the present invention to provide an adjustable mounting means for the auger in order to increase its workable life.

SUMMARY OF THE INVENTION

Therefore, I have invented a cement mixing and distribution apparatus which includes a material hopper controlled by a metering wheel assembly that supplies a material moving trough. The trough includes a power actuated auger mounted on an auger shaft.

The metering wheel assembly includes a hollow, cylindrical drum rotatably mounted to a drum shaft, a plurality of circumferentially spaced and radially extending vanes mounted on the exterior surface of the drum, and a plurality of hammer assemblies disposed along the length of the metering wheel assembly. Each of the hammer assemblies includes an inwardly directed impact plate mounted to the inner surface of the drum, an inwardly directed pusher plate mounted to the inner surface of the drum and angularly spaced from the impact plate, and a hammer rotatably mounted to the shaft and positioned between the impact plate and the pusher plate. During each revolution of the drum the pusher plate moves the hammer about the drum shaft until it is directed vertically upward, the force of gravity rotates the hammer downward until it strikes the impact plate, the impact plate rotates away while the hammer hangs vertically downward, and the pusher plate again contacts the hammer and moves the hammer about the drum shaft.

The hammer includes a cylindrical sleeve mounted around the drum shaft, an arm extending radially outward from and connected to the sleeve, and a ball connected to the end of the arm opposite the sleeve. The hammer assemblies are angularly offset from the adjacent hammer assemblies and are preferably evenly spaced about the entire circumference of the drum. The impact and pusher plates are angularly spaced by an angle of less than 180°, preferably by an angle of about 150°. Each pusher plate may be advantageously positioned opposite one of the vanes.

The auger shaft is mounted to an adjustable bearing assembly which includes an end plate mounted near one end of the trough and a bearing mounted on the end plate and rotatably carrying the auger shaft. The position of the end plate and, hence, the position of the auger, may be adjusted by means of a pair of mounting brackets mounted on the trough adjacent the end plate, a pair of vertical slots through the end plate and in line with the mounting brackets, and a bolt passing through each slot and mounting the end plate to the mounting brackets.

DESCRIPTION OF THE PREFERRED EMBODIMENTS

Figure 1:
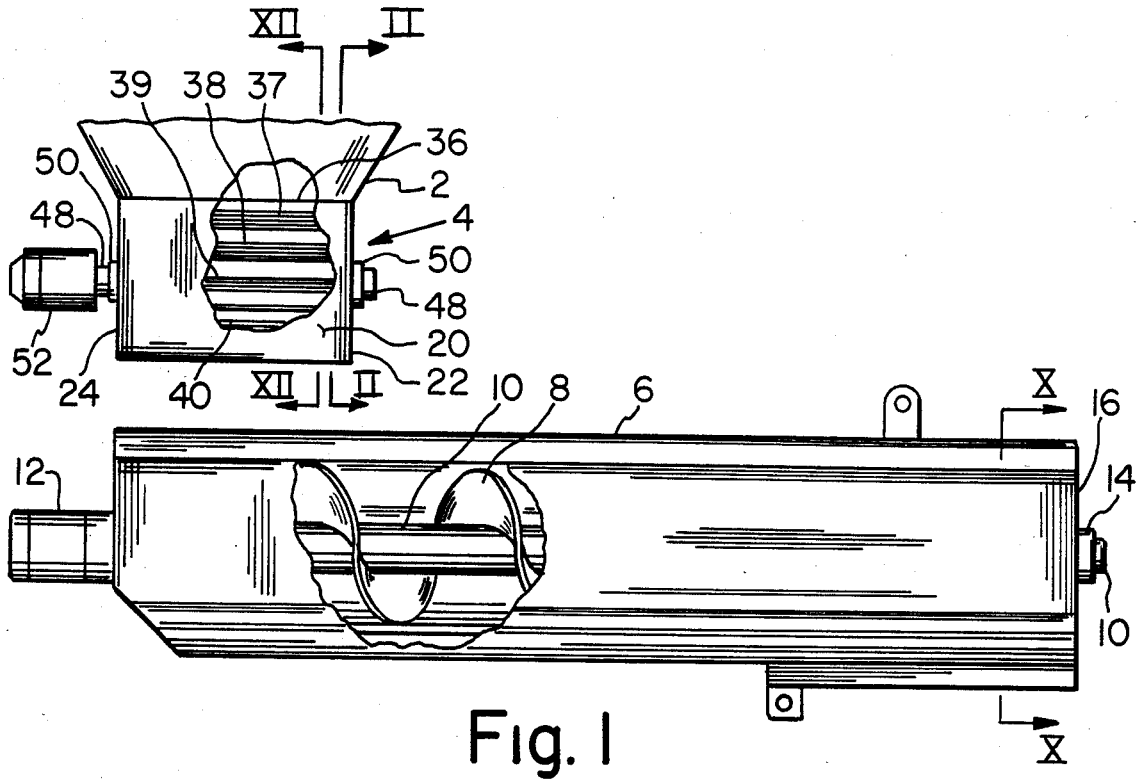
FIG. 1 is a side elevational view of a portion of a concrete mixing and distribution apparatus showing a metering wheel and an adjustable bearing assembly in accordance with the present invention.

Relevent portions of a cement mixing and distribution apparatus in accordance with the present invention are shown in FIG. 1. Included is a bin or hopper 2 adopted to hold dry cement, sand, wet concrete or other such material. The material, hereinafter referred to generally as cement, passes device 4 and onto one end of an elongated trough 6.

The trough 6 is adapted to move the cement from one end of the trough 6 to the other end over a long, straight length. The trough 6 includes a helical or screw auger 8 which is mounted on an auger shaft 10 and powered by an auger motor 12 or the like. One end of the auger shaft 10 is connected to the auger motor 12 at one end of the trough 6 and the other end of the auger shaft 10 is rotatably mounted within bearing 14 which in turn is mounted to the outside surface of an end plate 16 at the opposite end of the trough 6. In the arrangement shown in FIG. 1 the cement is deposited in the trough 6 at the end adjacent the auger motor 12 and, through the rotation of the auger 8 via the auger shaft 10, is moved along the trough 6 toward the opposite end at the end plate 16. The cement may then exit the trough 6 either beneath the end plate 16, as shown, or through any other opening provided for that purpose.

Figure 2:
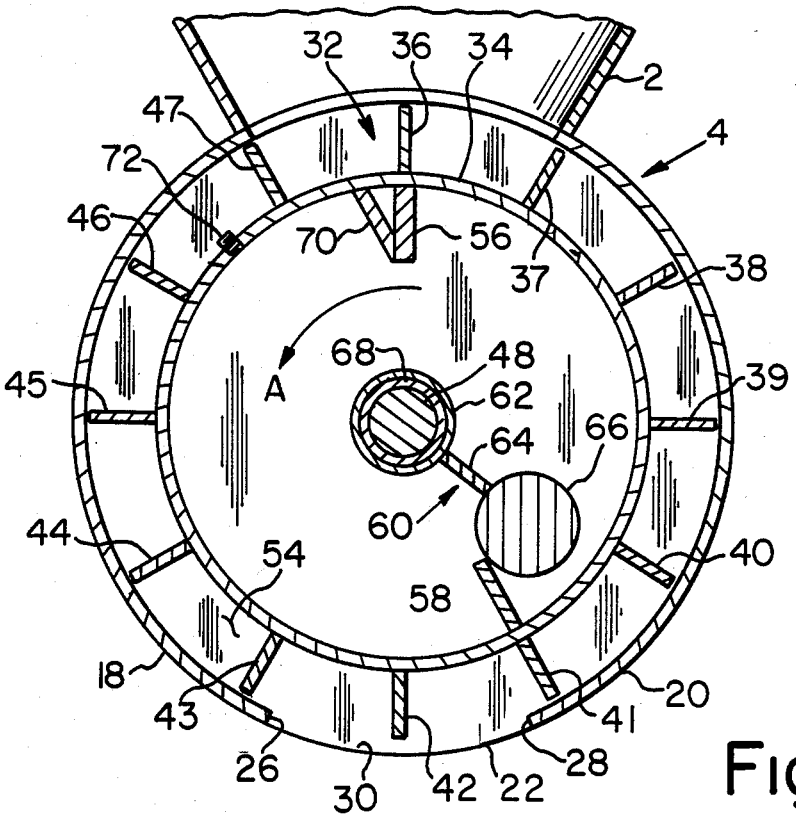
FIG. 2 is a section taken along lines II—II in FIG. 1 and showing the metering wheel in one rotational position.

Referring now to FIGS. 1 and 2, the metering device 4 includes a pair of opposed arcuate walls 18 and 20 which extend downwardly from the bottom of the hopper 2 and, preferably, a pair of opposed circular end walls 22 and 24 are joined to the adjacent ends of the arcuate walls 18, 20. The approach but do not touch one another and form an opening 30 therebetween. Together the arcuate walls 18 and 20 and end walls 22 and 24 form a housing for a rotatable metering wheel 32 mounted therein.

The metering wheel 32 includes a central, hollow cylindrical drum 34 with a plurality of circumferentially spaced and radially extending vanes mounted on the exterior surface of the drum 34. Shown in the Figures are twelve vanes spaced 30° apart, namely vanes 36, 37, 38, 39, 40, 41, 42, 43, 44, 45, 46, and 47, although it is to be understood that a greater or lesser number of vanes may be provided. The metering wheel 32 is securely fastened to a shaft, referred to as the drum shaft 48, in any well known manner. The drum shaft 48 is rotatably mounted to the end walls 22 and 24 by means of a suitable bearing 50 mounted thereto. The metering wheel 32 is rotated by a motor 52 or the like.

As is well known in the art, a compartment is formed between each successive pair of vanes, for example, compartment 54 shown in FIG. 2 between vane 43 and vane 44. As the metering wheel 32 is rotated by motor 52, a precise quantity of cement from the hopper 2 is deposited within each compartment, as determined by the volume of the compartment. The cement is moved downwardly from the hopper 2 and along the inside of one of the arcuate walls 18, 20 until it drops out through the opening 30 between the arcuate walls 18, 20 and onto the trough 6 below.

In order to preclude the cement from adhering to the metering wheel 32, a hammering mechanism is provided within the cylindrical drum 34 to provide a jarring or vibrating of the metering wheel 32. The hammering mechanism includes a plurality of identical hammer assemblies disposed along the length of the metering wheel 32. One such hammer assembly is shown in FIG. 2 and is typical of the remaining hammer assemblies.

The hammer assembly shown in FIG. 2 includes an inwardly directed impact plate 56 mounted onto the inner surface of the cylindrical drum 34. The hammer assembly also includes an inwardly directed pusher plate 58 mounted onto the inner surface of the cylindrical drum 34 and angularly or circumferentially spaced back from the impact plate 56. The impact plate 56 is mounted forward of the pusher plate 58 with respect to the direction of rotation of the cylindrical drum 34. In the embodiment shown in FIG. 2, the impact plate 56 is mounted opposite vane 36 and the pusher plate 58 is mounted opposite vane 41, for an angular separation of about 150°. Preferably the impact plate 56 and pusher plate 58 are separated by an angle of less than about 180°.

A hammer 60 is rotatably mounted to the drum shaft 48 and positioned between the impact plate 56 and the pusher plate 58. The hammer 60 includes a cylindrical sleeve 62 mounted around the drum shaft 48, an arm 64 extending radially outward from the sleeve 62, and a ball 66 connected to the end of the arm 64 opposite the sleeve 62. A bearing 68 is advantageously provided between the sleeve 62 and the drum shaft 48. The hammer 60 extends outward toward, but does not reach, the cylindrical drum 34 in order to provide for free rotation of the hammer 60 about the drum shaft 48.

Figure 3:
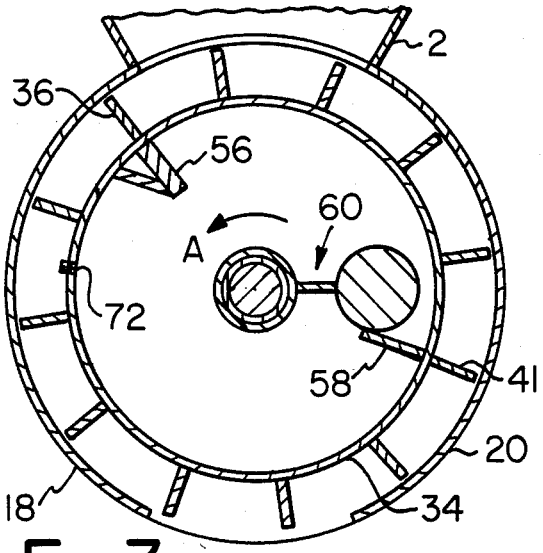
FIG. 3 is the sectional drawing of FIG. 2 showing the metering wheel in a second rotational position.
Figure 4:
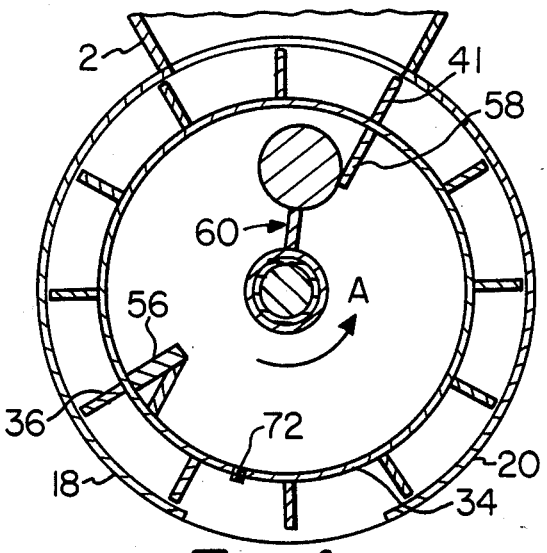
FIG. 4 is the sectional drawing of FIG. 2 showing the metering wheel in a third rotational position.
Figure 5:
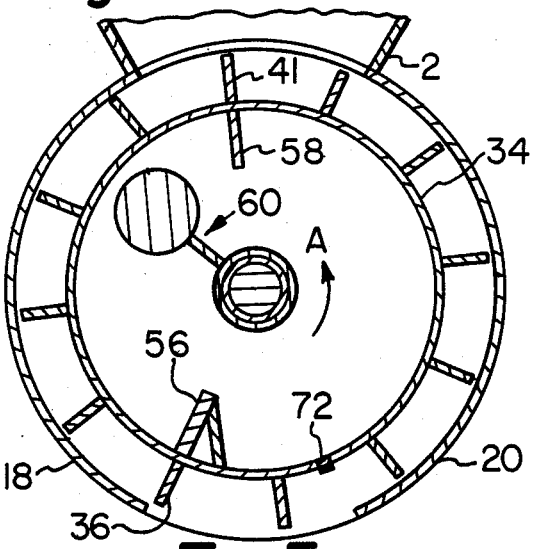
FIG. 5 is the sectional drawing of FIG. 2 showing the metering wheel in a fourth rotational position.
Figure 6:
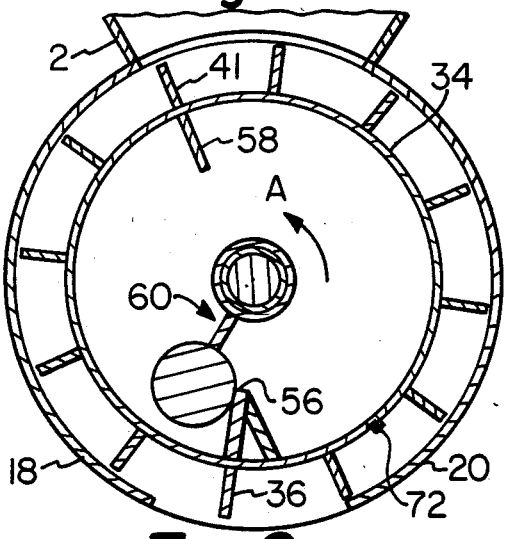
FIG. 6 is the sectional drawing of FIG. 2 showing the metering wheel in a fifth rotational position.
Figure 7:
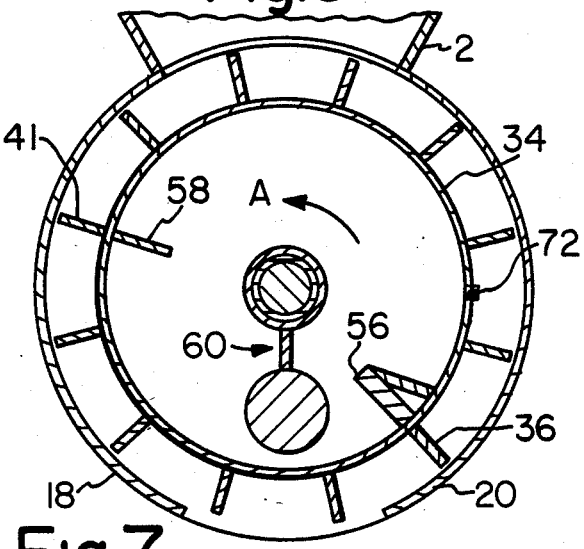
FIG. 7 is the sectional drawing of FIG. 2 showing the metering wheel in a sixth rotational position.
Figure 8:
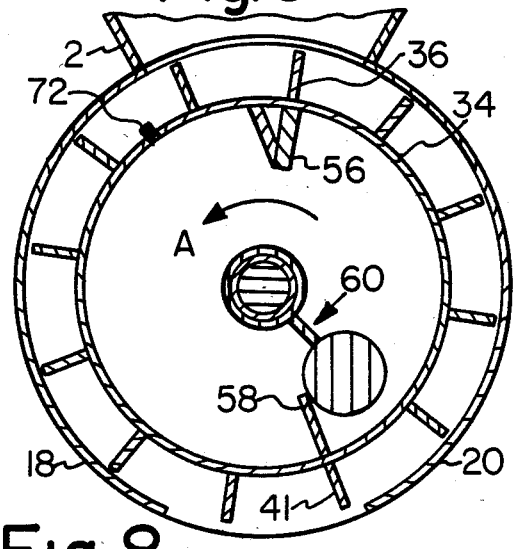
FIG. 8 is the sectional drawing of FIG. 2 showing the metering wheel in a seventh rotational position.
Figure 9:
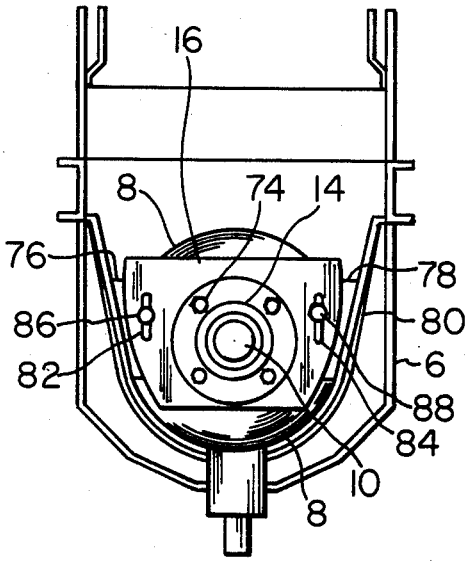
FIG. 9 is an end elevational view of the trough shown in FIG. 1 as viewed from the right side.
Figure 10:
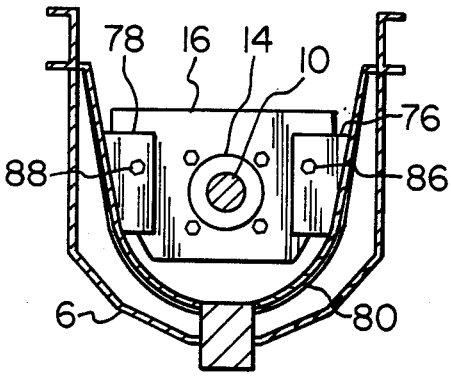
FIG. 10 is a section taken along lines X—X in FIG. 1 with the auger removed.
Figure 11:
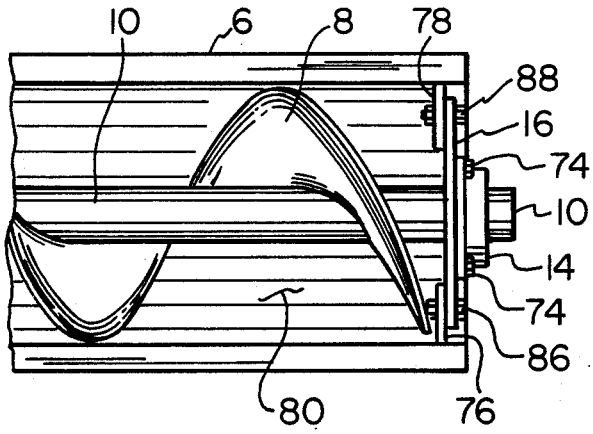
FIG. 11 is a top view of the position of the end of the trough shown in FIGS. 9 and 10.

The hammer 60 has no mechanism for moving it other than the pusher plate 58 and the force of gravity. The operation of the hammer assembly of the present invention is shown with reference to FIGS. 2–8, with the direction of rotation presumed to be counterclockwise as shown by the arrow marked A. In FIG. 2 the ball 66 of the hammer 60 has been contacted by the pusher plate 58 and is proceeding to be rotated counterclockwise about the drum shaft 48 toward the hopper 2 as shown in FIG. 3. As rotation continues, the pusher plate 58 and, hence, the hammer 60 will eventually reach the uppermost point of rotation, i.e., directed vertically upward, as shown in FIG. 4. When the pusher plate 58 passes through the uppermost point of rotation, the force of gravity will take over and cause the hammer 60 to quickly rotate about the drum shaft 48 and downward toward the impact plate 56. The hammer 60 will soon strike the impact plate 56 with a substantial force and will cause vibrations in the metering wheel 32 which will loosen any cement adhered thereto. If the impact plate 56 is angularly spaced from the pusher plate 58 by an angle of about 150°, as shown in the figures, the impact of the hammer 60 against the impact plate 56 will occur when the impact plate 56 is adjacent the discharge opening 30 and, thus, will be the most effective. After the impact, the hammer 60 will hang vertically downward as shown in FIG. 7 until the pusher plate 58 again rotates into contact with the hammer 60 as shown in FIG. 8. Then the above sequence will be completely repeated.

To strengthen the impact plate 56, a support plate 70 may be mounted between the cylindrical drum 34 and the side of the impact plate 56 opposite the hammer 60. The cylindrical drum 34 may be provided with an access hole therethrough, sealed with a plug 72, for introducing lubrication into the interior of the drum 34.

Figure 12:
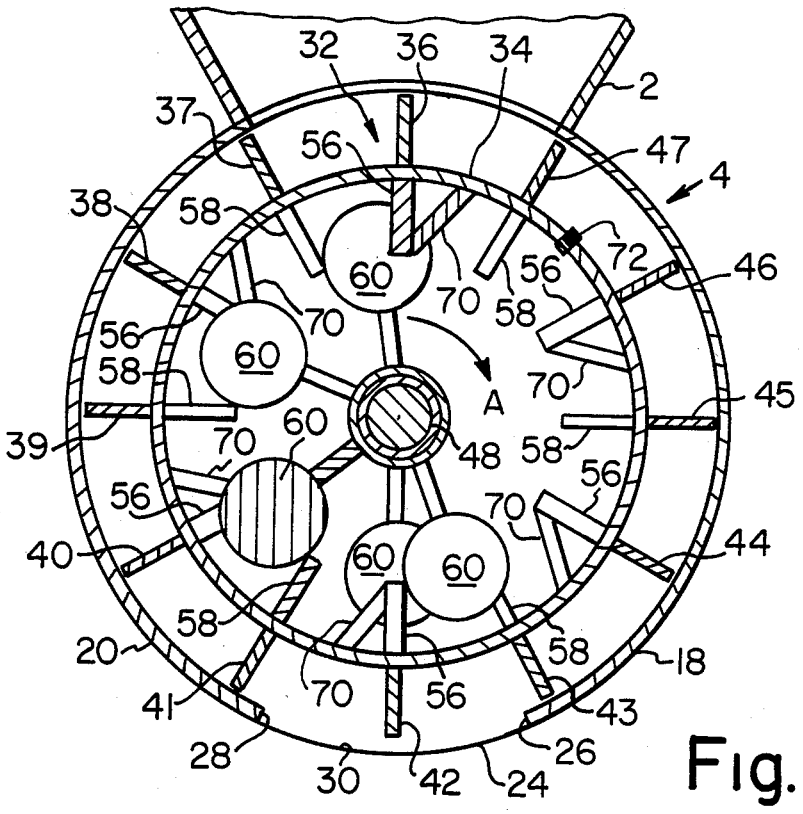
FIG. 12 is a section taken along lines XII—XII in FIG. 1.

As can be appreciated, one hammer assembly will produce one impact per revolution. To increase the number of impacts per revolution, it is preferable to provide a plurality of hammer assemblies within the cylindrical drum 34 and spaced along the drum shaft 48. In order to spread out the occurrence of the impacts during each revolution, it is preferable to angularly offset the hammer assemblies from each other. In the embodiment shown in FIGS. 2–8 and 12, the metering wheel 32 includes twelve evenly spaced vanes and it is preferable to include six such hammer assemblies angularly offset from one another by an angle of about 60°. The hammer assembly shown in FIG. 2 is positioned with the impact plate 56 adjacent vane 36 and the impact plate 58 adjacent vane 41. As shown in FIG. 12, the next adjacent hammer assembly has an impact plate 56 adjacent vane 46, a pusher plate 58 adjacent vane 39 and a hammer 60 therebetween. Similarly, the next four hammer assemblies have, respectively an impact plate 56 adjacent vanes 44, 42, 40, and 38, a pusher plate 58 adjacent vanes 37, 47, 45 and 43, and a hammer 60 therebetween. Each impact plate 56 is strengthened by a support plate 70. In this manner an impact plate 56 is provided on the interior of the cylindrical drum 34 adjacent alternating vanes and a pusher plate 58 is provided adjacent the remaining vanes. The vibration or rapping forces are thus evenly spread out and effectively prevent cement from adhering to the entire outer surface of the metering wheel 32.

An adjustable bearing assembly for the auger shaft 10 is shown in FIGS. 1 and 9–11. For clarity purposes, the auger 8 is not shown in FIG. 10. As mentioned above, the end of the auger shaft 10 opposite the auger motor 12 is held by bearing 14 which is mounted to an end plate 16 at the end of the trough 6. Bearing 14 is securely mounted to end plate 16 by a plurality of bolts 74 or the like. A pair of flat, narrow mounting brackets, namely bracket 76 and bracket 78, are mounted near the end of the trough 6 opposite the auger motor 12 along the inside surface of a material carrying channel 80 within the trough 6.

The end plate 16 is provided with a pair of elongated and, preferably, vertical slots therethrough, namely, slot 82 and slot 84, along the outer edges of the end plate 16 and in line with brackets 76 and 78. The end plate 16 is securely mounted to brackets 76 and 78 by passing bolt 86 through slot 82 and bracket 76 and by passing bolt 88 through slot 84 and bracket 78. The vertical position of the end plate 16 can be easily adjusted by loosening bolts 86 and 88 and sliding the end plate 16 up or down via slots 82 and 84.

Vertical movement of the end plate 16, which carries bearing 14 and the auger shaft 10, necessarily moves the auger 8 itself vertically up or down. It is desirable when moving cement or the like that the auger 8 maintain contact with the material carrying channel 80. Due to the abrasive nature of cement, the outer edges of the auger 8 will wear away until it is no longer in contact with channel 80. When this occurs, it is possible with the present invention to merely loosen bolts 86 and 88, slide the end plate 16 downward until the auger 8 again touches channel 80, and tighten bolts 86 and 88. This procedure may be performed a number of times and will increase the useful life of a typical auger by a factor of two or more.

Having described presently the preferred embodiments of my invention, it is to be understood that it may otherwise be embodied within the scope of the appended claims.

I claim:

1. A metering wheel assembly comprising:

(a) a hollow, cylindrical drum rotatably mounted to a shaft;

(b) a plurality of circumferentially spaced and radially extending vanes mounted on the exterior surface of the drum; and (c) a plurality of hammer assemblies located within the drum and disposed along the length of the metering wheel assembly, each of said hammer assemblies including:

(1) an inwardly directed impact plate mounted to the inner surface of the drum;

(2) an inwardly directed pusher plate mounted to the inner surface of the drum and angularly spaced from the impact plate; and (3) a hammer rotatably mounted to the shaft and positioned between the impact plate and the pusher plate, whereby during each revolution of the drum the pusher plate moves the hammer about the shaft until it is directed vertically upward, the force of gravity rotates the hammer downward until it strikes the impact plate, the impact plate rotates away while the hammer hangs vertically downward, and the pusher plate again contacts the hammer and moves the hammer about the shaft.

2. The metering wheel assembly of claim 1 wherein the hammer includes a cylindrical sleeve mounted around the shaft, an arm extending radially outward from and connected to the sleeve, and a ball connected to the end of the arm opposite the sleeve.

3. The metering wheel assembly of claim 1 wherein each hammer assembly is angularly offset from adjacent hammer assemblies.

4. The metering wheel assembly of claim 3 wherein the hammer assemblies are evenly spaced about the entire circumference of the drum.

5. The metering assembly of claim 1 wherein the impact plate and the pusher plate are angularly spaced by an angle of less than 180°.

6. The metering wheel assembly of claim 5 wherein the impact plate and the pusher plate are angularly spaced by an angle of about 150°.

7. The metering wheel assembly of claim 1 wherein each pusher plate is positioned opposite one of said vanes.

8. The metering wheel assemblies of claim 1 including six such hammer assemblies each of said hammer assemblies being angularly offset from adjacent hammer assemblies by an angle of about 60°, and wherein each impact plate is angularly spaced from its associated pusher plate by an angle of about 150°.

9. A cement mixing and distribution apparatus which includes a material hopper controlled by a metering wheel assembly and supplying a material moving trough, said trough including a power actuated auger mounted on a shaft, said metering wheel assembly comprising:

(a) a hollow, cylindrical drum rotatably mounted to a drum shaft;

(b) a plurality of circumferentially spaced and radially extending vanes mounted on the exterior surface of the drum; and (c) a plurality of hammer assemblies located within the drum and disposed along the length of the metering wheel assembly, each of said hammer assemblies including:

(1) an inwardly directed impact plate mounted to the inner surface of the drum;

(2) an inwardly directed pusher plate mounted to the inner surface of the drum and angularly spaced from the impact plate; and (3) a hammer rotatably mounted to the drum shaft and positioned between the impact plate and the pusher plate, whereby during each revolution of the drum the pusher plate moves the hammer about the drum shaft until it is directed vertically upward, the force of gravity rotates the hammer downward until it strikes the impact plate, the impact plate rotates away while the hammer hangs vertically downward, and the pusher plate again contacts the hammer and moves the hammer about the drum shaft.

10. The apparatus of claim 9 wherein the hammer includes a cylindrical sleeve mounted around the drum shaft, an arm extending radially outward from and connected to the sleeve, and a ball connected to the end of the arm opposite the sleeve.

11. The apparatus of claim 9 wherein each hammer assembly is angularly offset from adjacent hammer assemblies.

12. The apparatus of claim 11 wherein the hammer assemblies are evenly spaced about the entire circumference of the drum.

13. The apparatus of claim 9 wherein the impact plate and the pusher plate are angularly spaced by an angle less than 180°.

14. The apparatus of claim 13 wherein the impact plate and the pusher plate are angularly spaced by an angle of about 150°.

15. The apparatus of claim 9 wherein each pusher plate is positioned opposite one of said vanes.

16. The apparatus of claim 9 including six such hammer assemblies, each of said hammer assemblies being angularly offset from adjacent hammer assemblies by an angle of about 60°, and wherein each impact plate is angularly spaced from its associated pusher plate by an angle of about 150°.

17. The apparatus of claim 9 further including an adjustable bearing assembly for the auger shaft comprising:

(a) an end plate mounted near one end of the trough;

(b) a bearing mounted on the end plate and rotatably carrying the auger shaft; and (c) means for adjusting the position of the end plate relative to the trough.

18. The apparatus of claim 17 wherein the means for adjusting the position of the end plate includes:

(a) a pair of mounting brackets mounted on the trough adjacent the end plate;

(b) a pair of vertical slots through said end plate and in line with the mounting brackets; and (c) bolt means for releasably mounting the end plate to the brackets through the vertical slots;

whereby the position of the auger may be adjusted by loosening said bolt means, moving the end plate to another position along the vertical slots and tightening said bolt means.

* * * * *